United States Patent [19]

Valditerra et al.

[11] 4,430,813

[45] Feb. 14, 1984

[54] RAILROAD TRACK RELAYING MACHINE COMPRISING A PLOUGH

[75] Inventors: Sergio Valditerra, Novi Ligure, Italy; Ivo Cicin-Sain, Bussigny; Jaime Berga, Mezieres, both of Switzerland

[73] Assignee: Matisa Materiel Industriel S.A., Crissier, Switzerland

[21] Appl. No.: 322,933

[22] Filed: Nov. 19, 1981

Related U.S. Application Data

[63] Continuation-in-part of Ser. No. 227,681, Jan. 23, 1981, Pat. No. 4,403,430.

[30] Foreign Application Priority Data

Mar. 6, 1981 [EP] European Pat. Off. ..... 81200253

[51] Int. Cl.[3] ..... E02F 5/22

[52] U.S. Cl. ..... 37/104; 37/DIG. 18

[58] Field of Search ..... 37/104, 105, DIG. 18, 37/217; 171/16; 104/2, 4, 5–12; 172/40; 37/217, 272; 299/14, 141 R, 141 T

[56] References Cited

U.S. PATENT DOCUMENTS

| | | | |
|---|---|---|---|
| 345,257 | 7/1886 | Priest | 37/217 |
| 1,021,928 | 4/1912 | Hayward | 37/217 |
| 1,412,500 | 4/1922 | Zavatkay | 37/217 |
| 2,443,492 | 6/1948 | Austin | 37/141 R |
| 2,970,392 | 2/1961 | Perkins et al. | 172/40 |
| 3,251,628 | 5/1966 | Wrockloff | 172/40 |
| 3,628,265 | 12/1971 | Galis | 299/14 |
| 3,706,207 | 12/1972 | Cornelius et al. | 172/40 X |
| 3,994,081 | 11/1976 | Middleton | 299/14 |

FOREIGN PATENT DOCUMENTS

| | | | |
|---|---|---|---|
| 479574 | 7/1929 | Fed. Rep. of Germany | 37/272 |

*Primary Examiner*—E. H. Eickholt

*Attorney, Agent, or Firm*—Robert E. Burns; Emmanuel J. Lobato; Bruce L. Adams

[57] ABSTRACT

This plough adapted to be mounted on a railroad track-laying machine comprises in its plough area members capable of disaggregating and/or thrusting aside the old compact ballast. These members consist of ejectors acting like pistons and extending through apertures formed in the ploughshares; the ejectors movable across the normal direction of travel of the plough under the control are driven by an actuating mechanism imparting a reciprocating motion thereto, and may be replaced by blades disposed beneath, and substantially parallel to, the ploughshares, the actuating mechanism being adapted to impart to these blades a movement substantially of translation along a closed path.

8 Claims, 10 Drawing Figures

RAILROAD TRACK RELAYING MACHINE COMPRISING A PLOUGH

REFERENCE TO PRIOR APPLICATION

This application is a continuation-in-part of application Ser. No. 227,681 filed Jan. 23, 1981 now U.S. Pat. No. 4,403,430 issued June 20, 1983.

FIELD OF THE INVENTION

The present invention relates to a railroad track relaying machine comprising a plough of the type used in railroad track relaying machines for disaggregating the compact old ballast, after removing the old rails and ties, and preparing the lie for laying new ties.

THE PRIOR ART

Ploughs utilized for this purpose are already known in the art. These ploughs operate by simply penetrating into the ballast as a consequence of the forward travel of the machine supporting them, and have to overcome a considerable drag on the one hand because the gravel of the old ballast is extremely compact due to the ramming action exerted by the railroad traffic and also by the cementing action produced by mud, sludge, metal dust and other substances deposited upon, and penetrating into the bottom pitching, and on the other hand also because the relatively low operating speed of the machine cannot promote a regular flow of gravel displaced by the plough. Consequently, it is scarsely possible to plough a relatively deep furrow with ploughs of this type. In actual practice, the limit consists in levelling the ballast by pouring back into the furrows left by the removed old ties the gravel previously existing between adjacent ties, so that only a relatively small amount of gravel is pushed laterally. Thus, the new ties are laid at a higher level than required and a special machine must subsequently be used for excavating the pitching under the new ties in order to lower them sufficiently to restore the proper laying level upon completion of the subsequent packing operation necessary for raising the ties by one or two inches. In many cases the laying level of the new ties should be lower than that of the preceding ties, due to the laying of higher ties and/or rails, and also to the necessity of maintaining the rail plane at the same level as before, since standard requirements such as the height of the overhead feed lines, the tunnel and level crossing gage, and the like, must be met in all cases.

SUMMARY OF THE INVENTION

It is the primary object of the present invention to increase the efficiency of a machine of the type broadly set forth hereinabove so that this machine can plough without difficulty a furrow of such a depth that it can receive the new ties, without resorting to any subsequent operation for lowering the tie level, even when the new ties are higher, and the new rails heavier, than the old ties and rails, respectively.

For this purpose, the plough according to the present invention comprises in its ploughshare area a plurality of members adapted to disaggregate and/or push the ballast, said members being movably mounted on the plough frame and adapted to be driven by a mechanism for performing a periodic movement having a component perpendicular to the ploughshares and such that the outwardly directed ends of said members protrude from the ploughshares when said members are in their external operative positions in relation thereto.

Thus, the efficiency of the ploughshares pushing back the ballast in the conventional manner as the plough progresses along the track is increased by the action exerted by said members which further permits of disaggregating the ballast before the latter is pushed laterally by the ploughshares, since these members protrude at certain times below the lower edges of the ploughshares.

According to a preferred form of embodiment of the invention of companion application Ser. No. 227,681 filed Jan. 29, 1981, said members consist of piston-like ejectors extending through apertures formed in the lower portions of the ploughshares, said ejectors being adapted to be moved across the normal direction of travel of the plough by an actuating mechanism imparting a reciprocating motion thereto between inner positions in which they do not protrude from the lower portion of the ploughshares and outer positions in which they projects in relation to said ploughshares.

With this arrangement each ejector, during its movement from its inner position to its outer position, is caused to push or thrust positively a certain amount of gravel to one side, so that this amount of gravel is disaggregated and shifted without deriving the necessary energy from the plough forward motion, therefore by exerting a force which can be predetermined when designing and adjusting the actuating mechanism. During the next phase the ejector is retracted and does not interfere with the plough travel. Any mass of gravel thus moved by an ejector is subsequently taken over by the next ejector which, as a consequence of the divergent arrangement of the plough blades, operates on a greater width, until the gravel is pushed aside, that is, laterally of the cutting formed by the plough for laying the new ties. As a consequence of these repeated positive thrusts exerted on the masses of gravel to be disaggregated, the plough is capable of forming a furrow considerably deeper than those obtainable without using ejectors, and the cutting depth may be so selected that any subsequent lowering of the newly laid ties can be dispensed with.

In order to avoid the exertion of excessive lateral efforts on the plough-supporting machine, the actuating mechanism is preferably so designed that while a given number of ejectors are moved on one side a corresponding number of other ejectors are moved on the opposite side, so that the lateral stresses at least substantially balance each other.

The deeper excavation required centrally of the cutting for relieving the central portions of the cross-ties may be performed by a deeper pointed portion of each plough blade, as in conventional devices of this type, or by using a horizontal rotary cutter adapted to be rotated in one or the other direction according as it is desired to have a greater amount of gravel discharged on one or the other side of the cutting.

According to a preferred form of embodiment of the invention of the present application the aforesaid movable members comprise a pair of blades, preferably formed with teeth or the like on their outer surface and disposed under the ploughs and at least substantially parallel thereto, the actuating mechanism being adapted to impart a movement substantially of translation to said blades along a closed path.

Thus, the ballast is perfectly disaggregated by the blades which, as a consequence of their closed-loop movement combined with the forward travel of the machine, operate somewhat like a grinder.

Finally, in a further form of the embodiment of the present invention the ejectors and blades mentioned in the foregoing can be combined into a same plough.

The invention will now be described more in detail with reference to the accompanying drawings illustrating diagrammatically by way of example various forms of embodiment.

THE DRAWINGS

DESCRIPTION OF THE PREFERRED EMBODIMENTS

Reference will first be made to FIGS. 1 to 6 illustrating a first form of embodiment of a track relaying plough.

Figure 2:
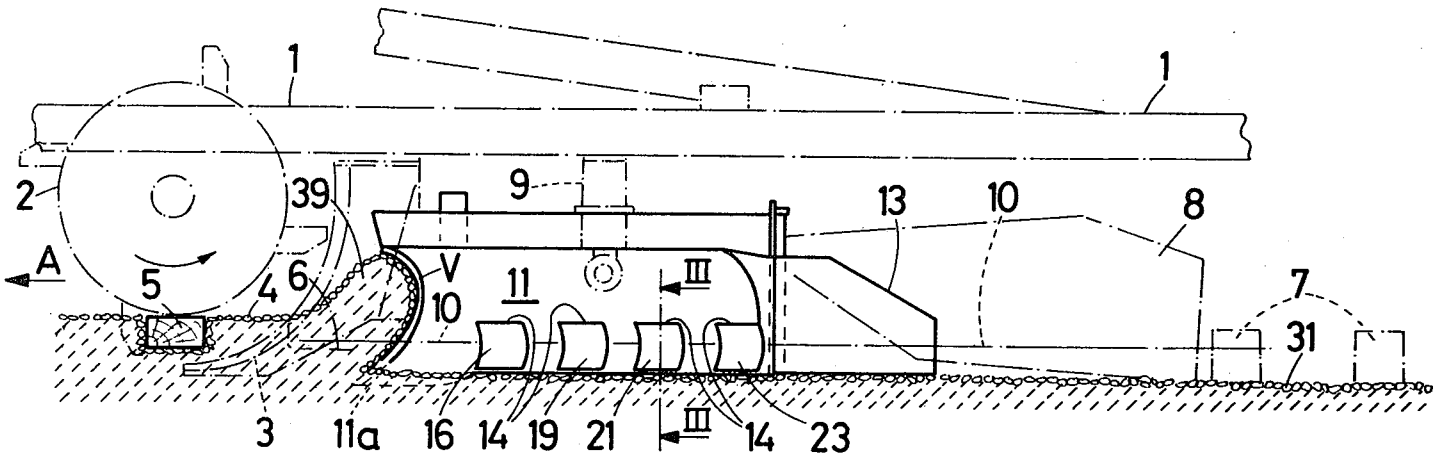
FIG. 2 is a side elevational view showing on a still smaller scale the same plough associated with certain elements of a track relaying machine, shown in dash and dot lines.

In FIG. 2 the reference numeral 1 designates a longitudinal member of the frame structure of a railroad track relaying machine of a type known per se, to which the plough of the present invention is attached. Reference numeral 2 designates a toothed wheel of this machine which, by cooperating with guide members 3, is adapted to remove the old cross-ties 5 from the old ballast 4, thus forming spaced empty transverse cavities 6. This machine also comprises means for laying the new ties 7, which comprise inter alia lateral metal plate 8 adapted, during the laying of new ties 7, to prevent the loosening or crumbling of the lateral gravel heaps formed by the plough. These heaps then slip partially behind the tail ends of the said plates 8, thus holding in position the freshly laid new ties 7. This plough is suspended from the frame structure 1 by means of supports 9. All these component elements, shown in dash and dot lines, are well known in the art. Furthermore, the dash and dot line 10 designates the level of the maximum depth attainable with a plough of conventional type, subject to the above-mentioned limitations.

In FIGS. 1–6 reference numeral 11 designates the two ploughshares or blades set at an angle to each other to constitute the plough according to the teachings of the present invention. These ploughshares are supported in the known fashion by a frame 12 suspended from the main frame structure of the machine by means of the above-mentioned supports 9. This frame 12 also carries vertical side plates 13 parallel to the direction of travel of the machine and constituting part extension of the rear ends of ploughshares 11; the function of these plates 13 consists in supporting the side heaps of gravel which, after having been released by said plates 13, are still temporarily retained by the lateral plates 8 of the machine. The ploughshares 11 have as usual a concave profile with an upper outwardly curved portion, substantially in the fashion of a mold-board for thrusting the gravel heaps formed by the plough towards the sides of the railroad track.

Figure 6:
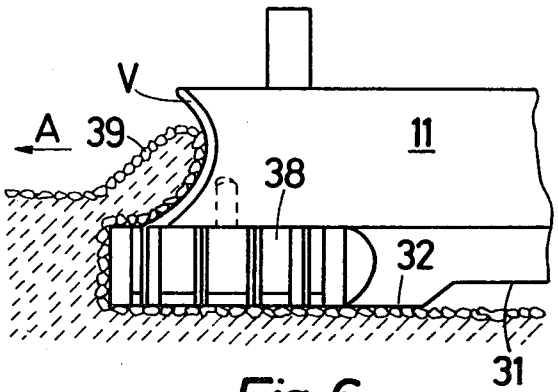
FIG. 6 is a fragmentary elevational view of the modified version of FIG. 5.
Figure 5:
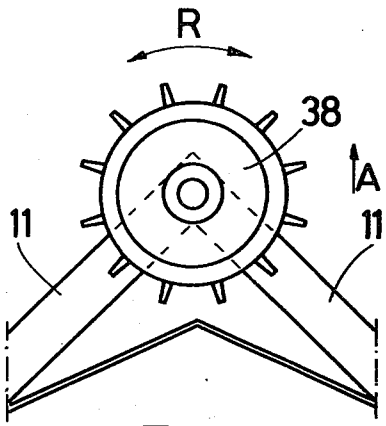
FIG. 5 is a fragmentary plan view from beneath showing a modified form of embodiment of the front portion of the plough of FIG. 1.
Figure 1:
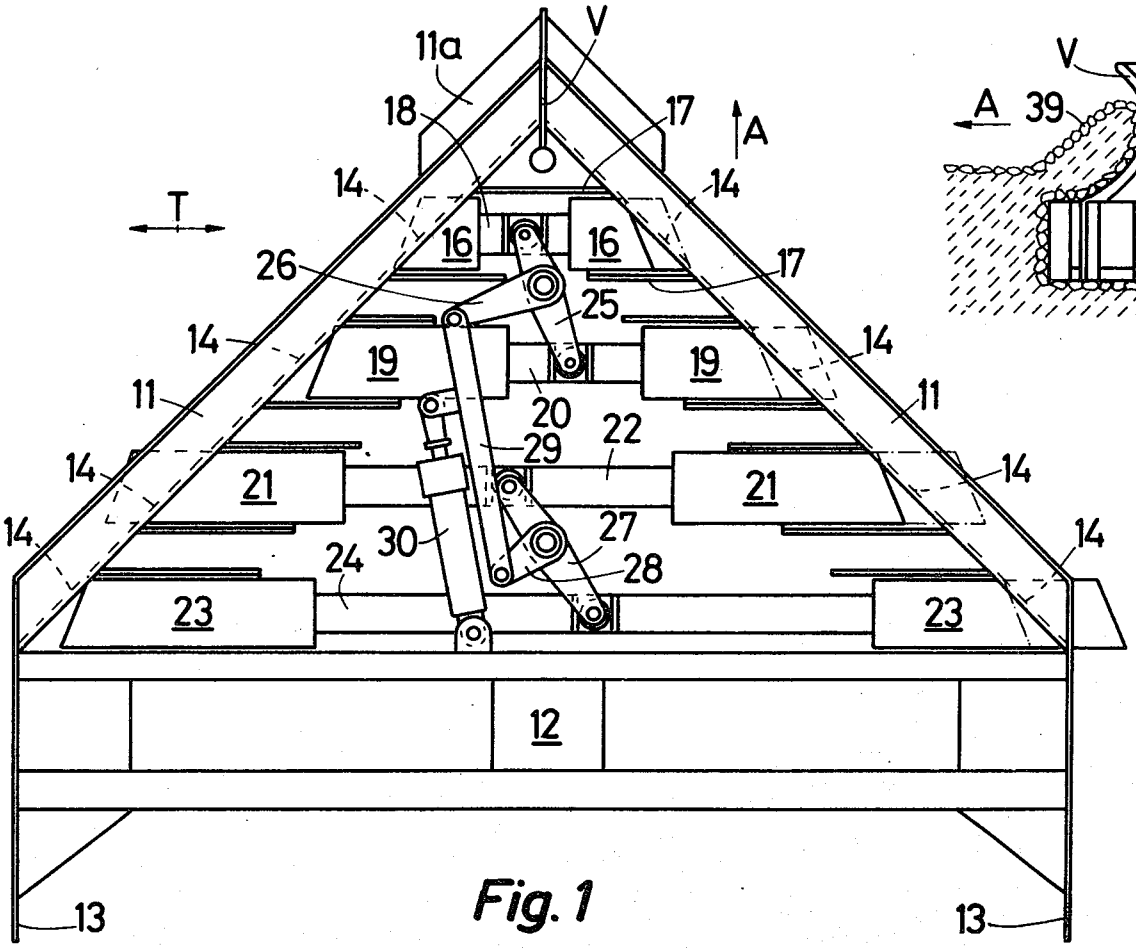
FIG. 1 is a plane view showing on a relatively small scale a form of embodiment of a ballast plough according to the invention of companion application Ser. No. 227,681 filed Jan. 29, 1981.

In the lower portion of each ploughshare 11 and more particularly in the portion thereof which is to be sunk into the ballast 4 to be disaggregated, horizontally spaced apertures 14, which in this exemplary form of embodiment are four in number and of substantially square cross-sectional configuration, are formed. The pair of apertures 14 nearest to the V-shaped apex of the plough have slidably fitted therein a pair of corresponding ejectors or pistons 16 movable in a transverse direction between guide members 17 and interconnected by a rod 18 so that the pair of ejectors 16 are caused to move in unison in said transverse direction as shown by the arrow T (FIG. 1). Similarly, the second pair of apertures 14 are occupied by a pair of ejectors 19, respectively, also interconnected by a rod 20 and guided for movement in the transverse direction T. The third and fourth pairs of apertures 14 are likewise occupied by third and fourth pairs of ejectors 21 and 23, respectively, interconnected by rods 22 and 24, respectively.

Rods 18 and 20 are interconnected in turn by a rocker lever 25 having arms of unequal lengths; this rocker lever 25 is pivoted to the fixed frame of the plough and has a third, transverse arm 26 rigidly attached thereto, as shown. Similarly, rods 22 and 24 are interconnected by a rocker lever 27 also provided with unequal arms and pivoted to the fixed frame of the plough; this rocker lever 27 is also provided with a transverse arm 28 rigidly attached thereto. Finally, the outer ends of transverse arms 26 and 28 are coupled by a rod 29 pivotally connected to the outer end of the piston rod of a hydraulic double-acting cylinder 30 reacting against the plough frame 12.

It is clear that when pressure fluid is supplied alternatively to one and the opposite end of cylinder 30, the rod 29 is reciprocated and imparts through transverse arms 26 and 28 an oscillatory motion to rocker levers 25 and 27, and also a rectilinear transverse reciprocation to the various ejectors 16, 19,21 and 23, so that while two ejectors move in one direction the other two move in the opposite direction. Moreover, the difference between the various lever arms is such that the amplitude of this movement increases from ejector 16 to ejector 23.

Each time an ejector is moved outwards and protrudes from the relevant aperture 14 formed in plough 11, it exerts a transverse force against the old ballast, thus disaggregating and moving a certain amount of gravel towards one side of the track. When subsequently the ejector is retracted an empty space is formed through which the plough can progress without having to overcome any appreciable resistance. The already shifted mass of gravel is subsequently taken over by the next ejector behind and also moved laterally outwards, with a greater amplitude of movement to compensate the increased amount of gravel accumulating in front of the following ejectors. Thus, all the ballast gravel is gradually pushed to the track sides and subsequently retained temporarily by the metal plates 13 to prevent the inward fall of this gravel.

Due to the improved efficiency of the plough of this invention, full-depth cuttings can be obtained, i.e. down to the level shown diagrammatically at 31 in FIG. 2, for laying the new ties 7 even if they higher than the old ones, without excavating several times under the ties, in contrast to the procedure required with conventional ploughs which can only cut down to the level shown at 10, by way of comparison, in FIG. 2, that is, a level requiring several passes of a suitable excavating tool.

Figure 4:
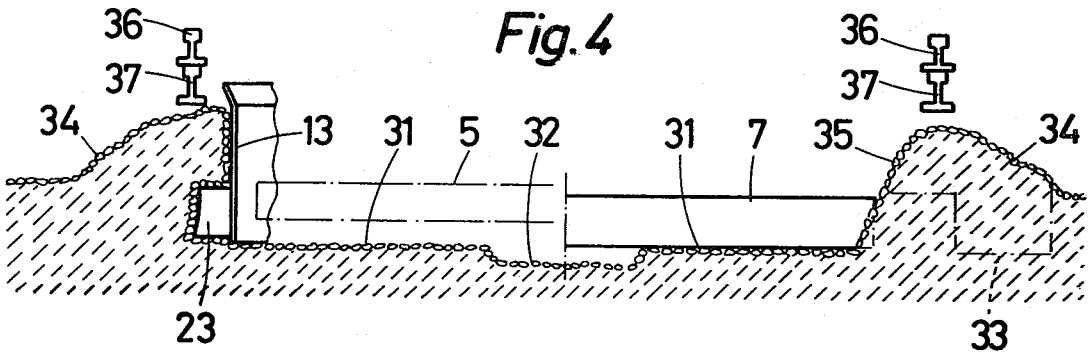
FIG. 4 is a cross section showing the cutting formed by the plough.
Figure 3:
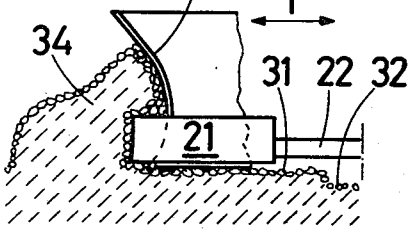
FIG. 3 is a fragmentary vertical section taken along the line III—III of FIG. 2.

Preferably, to facilitate the subsequent steps of the track relaying process, a pair of small auxiliary plough adapted to be mounted either to the same track-relaying machine or to another machine to be passed on the railroad line before the renewal thereof, may be used for making small lateral cutting such as the one designated at 33 in FIG. 4 for receiving one portion of the gravel disaggregated by the plough, the excess gravel forming heaps 34 momentarily retained by the metal plates 13 of the plough and then by the plates 8 of the track relaying machine; after the passage of these plates 8, as shown in the right-hand portion of the same FIG. 4, the heap 34 collapses partially, thus forming a slope 35 in which the ends of the freshly laid new ties 7 are embedded and safely held in position. The heaps 34 are formed below the level of the new rails 37 which are lifted temporarily by the machine according to the conventional method along the edges of the cutting, the old rails 36 to be removed overlying the new rails 37, as shown in FIG. 4.

It is also known that the central portion of the cutting formed for laying the new ties 7 must be lowered to level 32 beneath the actual laying level 31 in order to relieve the central portion of the ties themselves. This can be obtained as conventional by providing the ploughshares 11 of the plough of this invention with a complementary front element 11*a* projecting down to said level 32. The same result may also be obtained according to the invention by mounting under the front end of ploughshare 11 a horizontal cutter 38 (FIGS. 5 and 6) rotatably driven by a suitable electric or hydraulic motor. By using the same cutter 38 is it also possible to shift the dislodged gravel mainly on one side, if desired, by selecting the corresponding direction of rotation R, and in each case the height of the gravel heap 39 formed in front of the plough vertex V is reduced, so as to diminish the drag accordingly.

It will be readily understood by those conversant with the art that various modifications and changes may be brought to the form of embodiment described hereinabove. Thus, for instance, the shape, number and position of the ejectors may vary, as well as the nature and relative arrangement of the means provided for actuating them. Said means may comprise for example linkages operatively connected to a single source of driving power, as in the example described and illustrated, but it is also possible to provide several separate power source coupled directly or indirectly to the ejectors. Hydraulic cylinders may advantageously be used as power sources for this purpose, inasmuch as there is a hydraulic system on board track relaying machines; however, mechanical or electro-mechanical power sources may also be used, if desired or adequate. The ejectors forming a couple on either side of the plough may also be actuated in opposite directions instead of being interconnected by a rod.

Figure 7:
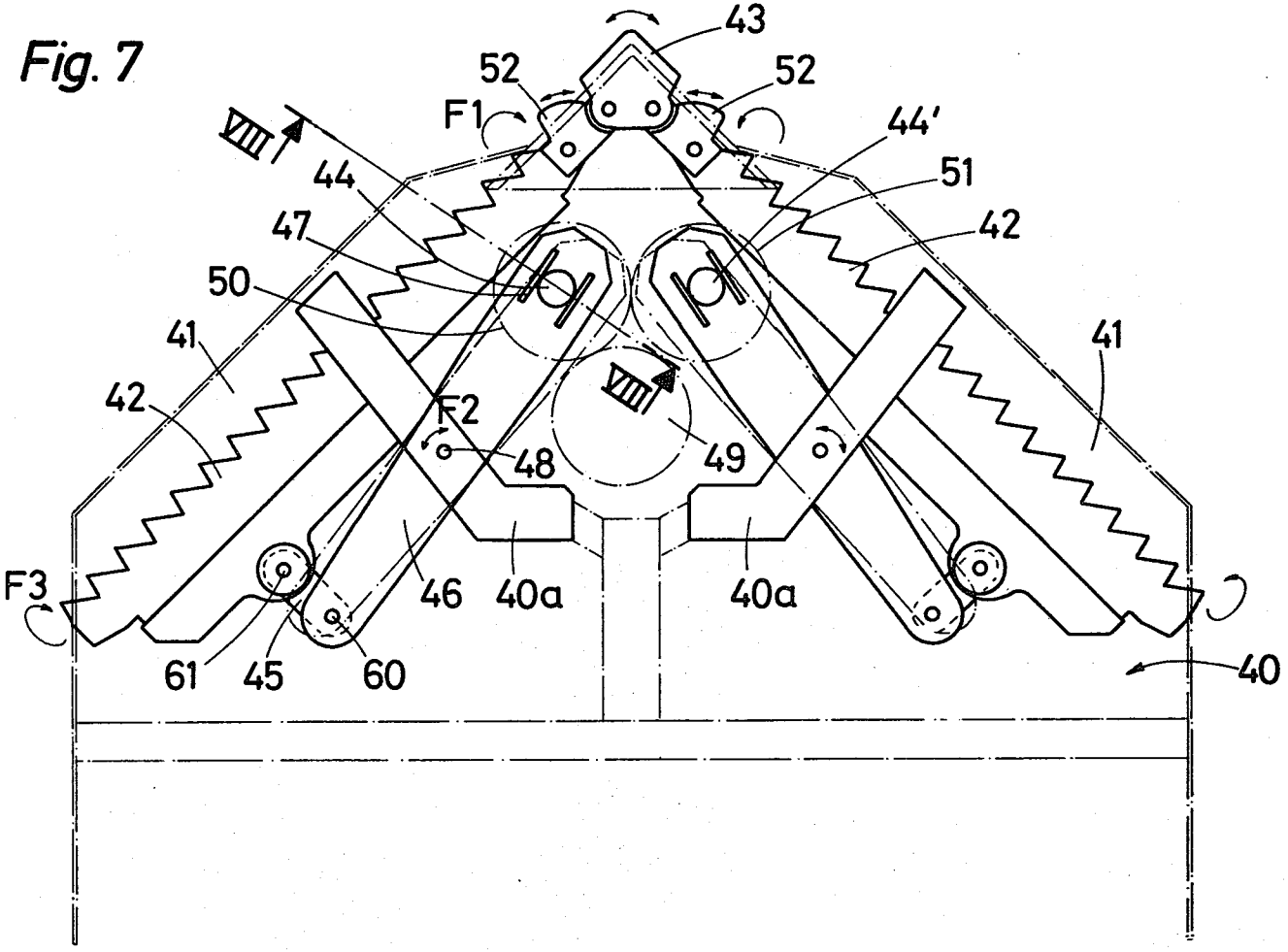
FIG. 7 is a plan view from above of a preferred form of embodiment of a ballast plough according to this invention.
Figure 8:
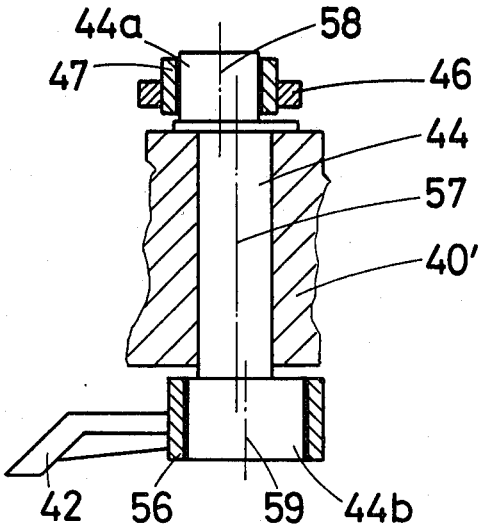
FIG. 8 is a fragmentary, diagrammatical detail view showing on a larger scale and in section taken along the line VIII—VIII of FIG. 7 the relationship between the two eccentrics.
Figure 9:
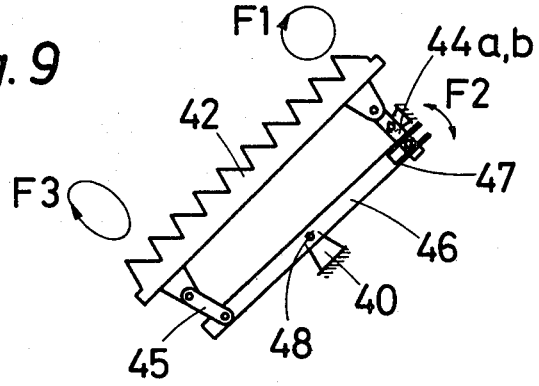
FIG. 9 is a diagrammatic view showing the blade mounting linkage means in order to afford a clearer understanding of its combined movements.

Reference will now be made to FIGS. 7, 8 and 9 illustrating diagrammatically a preferred form of embodiment of the plough of this invention. In this form of embodiment, the ejectors or pistons of the first form of embodiment are replaced by a pair of blades 42 disposed beneath, and at least substantially parallel to the two ploughshares 41; these blades are actuated by a suitable mechanism capable of imparting thereto a movement approximatively of translation along a closed loop or path. The mechanism is so conceived that each blade 42 accomplishes a circular movement with its front end and an elliptic movement with its rear end, as will be explained hereinafter.

As in the form of embodiment shown in FIG. 1, the two ploughshares 41 forming an angle in relation to each other are fastened to the plough frame comprising lateral supporting arms 40*a*. This frame 40 has also detachably mounted thereto a pair of blades 42 complementarily and pivotally interconnected at their front ends through a pair of teeth 52 and a nose member 43, as shown notably in FIG. 7. Each blade 42 has its front end pivotally connected through a bearing 56 to an eccentric 44*b* depending from and rigid with a shaft 44 (FIG. 8), and the rear portion of blade 42 is pivotally connected through a pin 61 to a link 45 pivoted in turn through another pin 60 to a larger rod 46. This rod 46 carries at its front end a fork 47 shown only diagrammatically in FIGS. 7, 8 and engaged by another eccentric 44*a* constituting the upper portion of shaft 44. On the other hand, the rod 46 is fulcrumed for free oscillation about a pivot pin 48 carried by the lateral supporting arm 40*a* of the plough frame. As clearly shown in FIG. 8, the shaft 44 with its integral eccentric portions 44*a* and 44*b* is adapted to rotate about the axis 57 and so arranged that the upper eccentric 44*a* having an axis of rotation 58 is shifted angularly by 180 degrees with respect to the lower eccentric 44*b* having an axis of rotation 59.

The blades 42 are pivotally connected at their front ends through a pair of rounded teeth 52 to the nose member 43 constituting the foremost element of the plough, the lower edges of this nose member 43 and of both teeth 52 being on the other hand disposed at lower level than the blades 42 in order to cut a deeper central channel or furrow, as already explained with reference to the first form of embodiment.

This mechanism is driven from a power pinion 49 meshing with a toothed wheel 50 rotatably solid with the first eccentric shaft 44, this toothed wheel 50 being in constant meshing engagement with, and driving in turn, another toothed wheel 51 rotatably solid with the other eccentric shaft 44', the gearing being enclosed in a case 40' rigid with frame 40.

The eccentric shaft 44 will thus impart on the one hand to blade 42, through its lower eccentric 44*b*, a circular motion having a radius corresponding to the throw of this eccentric, as illustrated by the arrow F1, and on the other hand to rod 46, through the fork 47, a oscillatory motion about pivot pin 48, as shown by the arrow F2. The amplitude of the oscillatory motion imparted to the other end of rod 46 and therefore to pivot pin 60 through which the link 45 is pivotally connected to said rod, is subordinate to the lever ratio of rod 46 and also to the throw of eccentric 44*a*. It is thus possible to vary the amplitude of this oscillation by properly selecting the ratio of the lever arms of rod 46. The end of link 45 and consequently the rear end of blade 42 to which it is pivotally connected by means of pivot pin 61 are thus caused positively to describe an elliptic path illustrated by the arrow F3 (FIG. 7) and this movement results from the circular movement accomplished by the front end of blade 42 and also from the oscillation of rod 46, the major axis of this elliptic path F3 being substantially perpendicular to the blade 42. Therefore, these movements are synchronised by rod 46. Preferably, the lever arm ratio of rod 46 and throw of eccentrics 44*a* and 44*b* are selected with a view to amplify the movement performed by the rear portion of the blade with respect to that of its front portion, so that the major axis of the elliptic path be greater than the radius of the circular path described by the front portion of blade 42.

By virtue of this combined movement the amplitude of movement of the rear portions of the plough blades is constantly greater than that of the front portions, and this difference is particularly useful for pushing forward and laterally the ballast accumulating toward the rear of the machine. The principle of this combined movement is illustrated diagrammatically in FIG. 9 in which the two eccentrics 44*a* and 44*b* are replaced by a lever 44*a,b*.

This movement can be modified at any time as a function of the values of throws 44*a* and 44*b*, of the eccentric ratio of shaft 44 and of the lever arm ratio of rod 46. Preferably, the arrangement of the various component elements is such that an asymmetric movement is obtained, i.e. when the blade 42 protrudes laterally from the lower portion of ploughshare 41 the other blade is retracted. Since the nose member 43 of the plough is pivotally mounted in relation to the two blades 42 by means of the two end teeth 52, the asymmetric movement of the two blades 42 causes this nose member 43 to follow an oscillatory path adapted to facilitate the penetration of the blades into the ballast.

According to another preferred form of embodiment of the invention, a motor is provided for driving pinion 49 at a velocity of 100 to 300 r.p.m. and the ratios of the eccentrics and of the arms are such that the amplitude of the movement measured at the lower portion of the blade is about 3 centimeters against about 6 centimeters for the rear portion.

In another modified form of embodiment illustrated in FIG. 10, the system described hereinabove, comprising lateral ejectors or pistons 53, is superposed to the system comprising the blades 42, whereby the ballast accumulated as a consequence of the forward motion of the plough can be expelled. This modified arrangement constitutes a combined plough associating the advantageous features of the two previously described plough arrangements.

Figure 10:
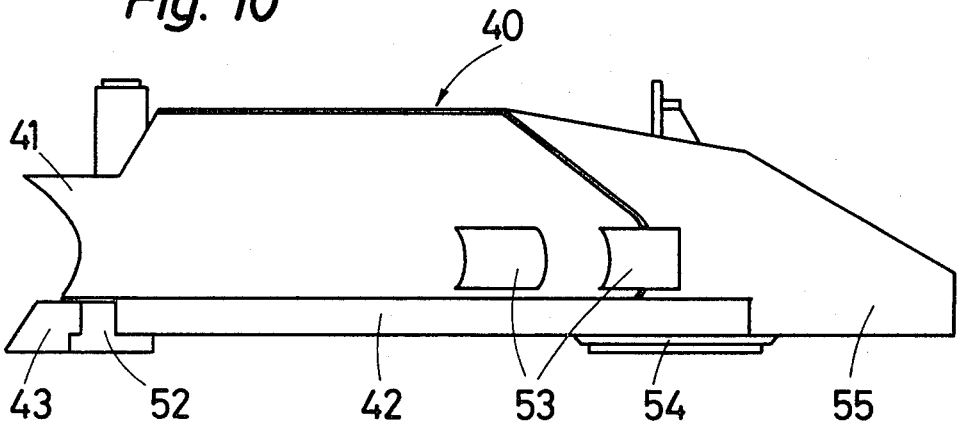
FIG. 10 is a side elevational view showing another form of embodiment of the plough which is a combination of the forms of embodiment shown in FIGS. 1 and 7.

FIG. 10 further shows a vibrator 54 of a type known per se, which is secured to the plough frame together with a rectilinear plate 55 constituting the extension of ploughshares 41 and serving the purpose of temporarily retaining the gravel accumulated along the edges of the cutting.

Of course other modifications and changes may be contemplated by those skilled in the art in the practical embodiment of the invention without departing from the basic principles thereof.

What is claimed is:

1. A railroad track relaying machine comprising a plough frame, a V-plough on said frame for ejecting laterally the compact old ballast and forming a cut for laying new ties, two blades provided in the ploughshare area of said plough for disaggregating and/or thrusting aside the old ballast, said blades being movably mounted on the plough frame beneath and substantially parallel to said ploughshares, and actuating means for imparting to said blades periodic movement of translation along a closed path having a component perpendicular to the ploughshares and such that outer portions of said blades protrude, in the outer operating position thereof, from said ploughshares, said actuating means comprising means for imparting a circular motion to the front portion of each blade and means for imparting an elliptical motion to the rear portion of each blade, said elliptical motion having its major axis substantially perpendicular to said ploughshare.

2. The machine of claim 1, wherein said actuating means for each blade comprises an eccentric shaft, the front end of each blade being connected to a first eccentric formed at the lower portion of said eccentric shaft provided at its upper portion with another eccentric opposite said first eccentric and connected through a fork to the end of a lever adapted to be oscillated about a pivot pin carried by a support rigid with the plough frame, the other end of said lever being connected through a link to the rear end of the blade, the two eccentric shafts associated respectively with the two blades being driven by a single motor.

3. The machine of claim 1, wherein each blade is provided at its front end with a pivoted tooth, and that wherein a nose member pivotally connected in turn to the two teeth interconnects said blades, said nose member and teeth having a lower edge located at a lower level than the lower edges of said blades, the movement of said blades being so shifted in phase relative to each other that said nose member describes an oscillatory movement consistent with the periodic movement of said blades.

4. The machine of claim 1, which further comprises at least one pair of ejectors extending through corresponding apertures formed in said ploughshares and adapted to be moved across the normal direction of travel of the plough and actuating mechanism for moving said ejectors.

5. The machine of claim 1, wherein a horizontal cutter is provided beneath the front end of said ploughshares and adapted to be rotated in one or the other direction, said cutter projecting below the lower edge of said ploughshares.

6. The machine of claim 1, wherein said blades are provided with teeth on their outer surfaces.

7. The machine of claim 6, wherein said teeth have the configuration of saw teeth with forward faces inclined to the longitudinal axis of the blades at a lesser angle than rearward faces.

8. The machine of claim 1, wherein said actuating means comprises a common power source for moving both blades, and wherein said actuating means moves said blade at one side of the plough outwardly while moving said blade at the opposite side of the plough inwardly.

* * * * *